United States Patent [19]

Pfizenmaier

[11] Patent Number: 4,527,069

[45] Date of Patent: Jul. 2, 1985

[54] DEVICE FOR CONTROLLING THE LATERAL POSITION OF A WEB IN A WEB PRINTING MACHINE

[75] Inventor: Wolfgang Pfizenmaier, Neckargemünd, Fed. Rep. of Germany

[73] Assignee: Heidelberger Druckmaschinen AG, Heidelberg, Fed. Rep. of Germany

[21] Appl. No.: 431,634

[22] Filed: Sep. 30, 1982

[30] Foreign Application Priority Data

Oct. 24, 1981 [DE] Fed. Rep. of Germany ..... 3142316

[51] Int. Cl.[3] ..... G01H 21/86

[52] U.S. Cl. ..... 250/548; 250/557

[58] Field of Search ..... 250/548, 557, 561; 242/57.1; 226/20; 26/51.5; 356/375, 386, 429, 430

[56] References Cited

U.S. PATENT DOCUMENTS

| | | | |
|---|---|---|---|
| 2,623,262 | 12/1952 | Berry | 26/51.5 |
| 3,604,940 | 9/1971 | Matthews | 356/386 |
| 3,746,451 | 7/1973 | Croissant et al. | 356/430 |
| 4,184,080 | 1/1980 | Massey | 250/548 |

*Primary Examiner*—David C. Nelms

*Assistant Examiner*—James Gatto

*Attorney, Agent, or Firm*—Herbert L. Lerner

[57] ABSTRACT

Device for controlling with adjusting members and a measuring device the lateral position of a web in a web printing machine, the controlling device, for effecting centralized control, having respective optical scanning systems for detecting edges of the web on both sides thereof and the respective positions of the edges and, upon lateral shifting of the web, activating the adjusting members for correcting the position of the web in accordance with a nominal value, including a respective bandpass filter connected to each of the optical scanning systems, and means for detecting a long-term change in the control signal by the bandpass filter of one of the optical scanning systems, the one optical scanning system being in position yet being idle with respect to controlling the lateral position of the web, the other optical scanning system being active with respect to scanning the respective web edge for controlling the lateral position of the web, the detection of the long-term change in the control signal by the bandpass filter of the one optical scanning system being an indication of fouling of the optical scanning systems, whereby compensation for the fouling may be effected.

3 Claims, 1 Drawing Figure

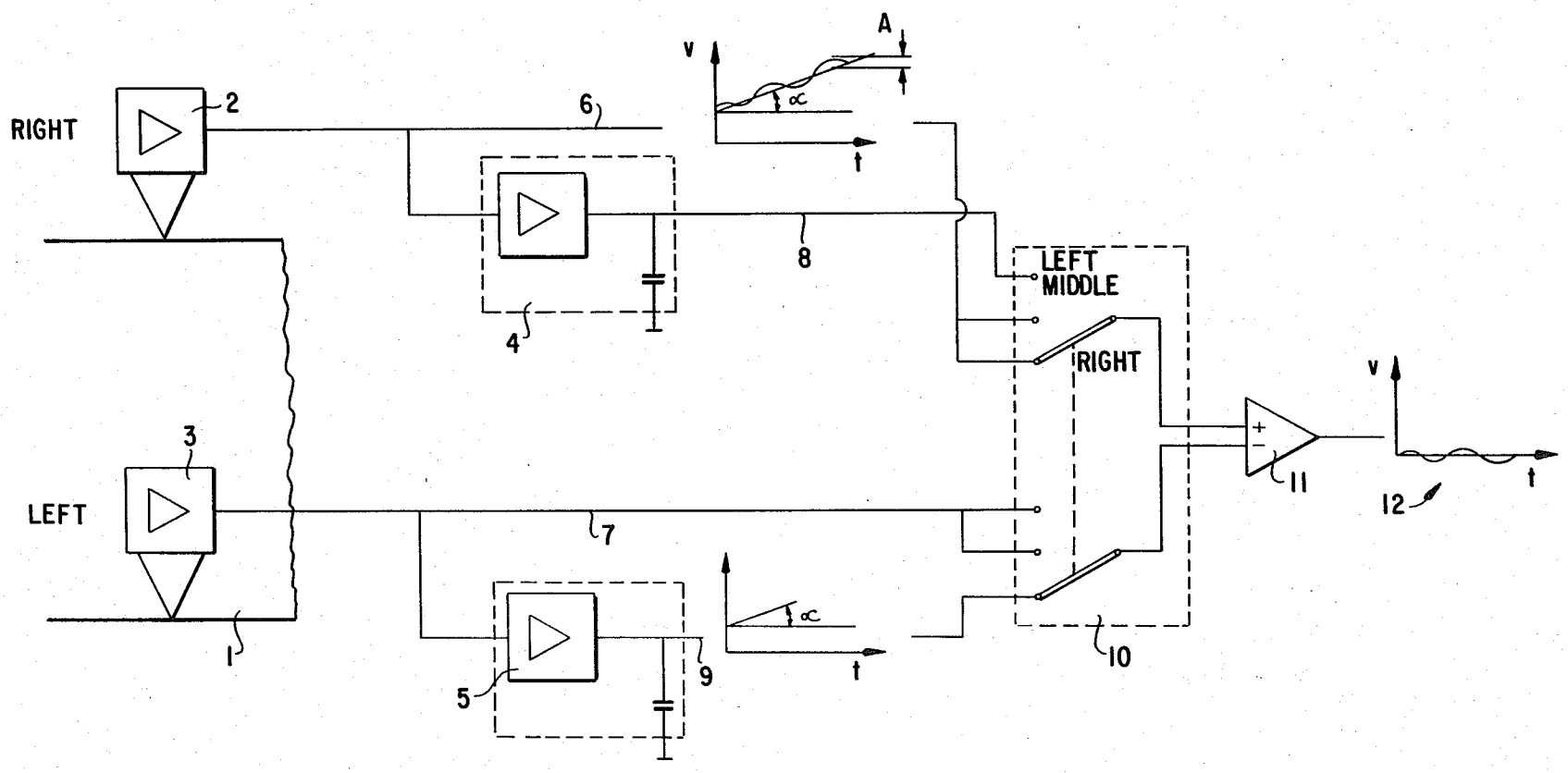
RIGHT
LEFT
LEFT
MIDDLE
RIGHT
A
v
t
α
1
2
3
4
5
6
7
8
9
10
11
12

DEVICE FOR CONTROLLING THE LATERAL POSITION OF A WEB IN A WEB PRINTING MACHINE

The invention relates to a device for controlling the lateral position of a web in a web printing machine and, more particularly, to such a device effecting control with adjusting members and a measuring device, the controlling device, for effecting centralized control, having respective optical scanning systems for detecting edges of the web on both sides thereof and the respective positions of the edges and, upon lateral shifting of the web, activating the adjusting members for correcting the position of the web in accordance with a nominal value or setpoint.

Such devices are known and serve the purpose of feeding to the printing units a web which had previously been printed on so that a subsequent printing operation may be performed in register i.e. applied always to the same location in relation to the paper web.

The control system may be implemented in many different ways using various control sensors for the edge of the paper web. Thus, German Pat. No. 2252490 shows a sensor-controlled web guidance system wherein the problem consists of likewise precisely controlling paper webs of varying widths. Photoelectric devices are also already known as control sensors which scan the edge of the paper web. The instant the web of imprinted material experiences a lateral change, a control signal is transmitted to adjusting members from the optical scanning system and, on the basis of this control signal, the positioning control of the web with respect to a desired or nominal value is effected.

A disadvantage of the optical scanning systems predominantly used in web printing machines is that they are very sensitive to fouling, for example, due to paper dust. Increasing fouling is interpreted by the optical system as a shift in position of the web edge and leads to an undesired correction of the position of the web edge. This error occurring due to fouling may add up to several millimeters per day, especially in the case of heavy paper fluffing, and must be compensated for several times a day by the intervention of the printer. A particular problem is that a change-over from one side control to the other and a cleansing of the optical system leads to an erratic or sudden change in position of the paper web. A possible result thereof is that, when removing the dust, the paper web may tear so that the printer is then compelled to stop the printing machine in order to clean the photoelectric cells.

It is accordingly an object of the invention to provide a device for controlling the lateral position of a web in a web printing machine wherein fouling of the optical scanning systems and side change-over do not result in erroneous control of the web, and wherein it is unnecessary to clean the scanning systems during operation of the machine.

With the foregoing and other objects in view, there is provided, in accordance with the invention a device for controlling with adjusting members and a measuring device the lateral position of a web in a web printing machine, the controlling device, for effecting centralized control, having respective optical scanning systems for detecting edges of the web on both sides thereof and the respective positions of the edges and, upon lateral shifting of the web, activating the adjusting members for correcting the position of the web in accordance with a nominal value, comprising a respective bandpass filter connected to each of the optical scanning systems, and means for detecting a long-term change in the control signal by the bandpass filter of one of the optical scanning systems, the one optical scanning system being in position yet being idle with respect to controlling the lateral position of the web, the other optical scanning system being active with respect to scanning the respective web edge for controlling the lateral position of the web, the detection of the long-term change in the control signal by the bandpass filter of the one optical scanning system being an indication of fouling of the optical scanning systems, whereby compensation for the fouling may be effected.

In accordance with another feature of the invention the optical scanning devices include photoelectric cells for scanning the web edges.

In accordance with a further feature of the invention there is provided a switch means for switching over the control of the lateral position of the web from the optical scanning system at the web edge on one side of the web to that at the other side of the web and to a centralized control.

As a result of the control compensation effected by the otherwise idle opposing scanning system in conjunction with the respective bandpass filter thereof, the lateral position of the web remains constant when control is switched over from one side to the other or to centralized control and, also, when fouling of the scanning systems occur, without faulty or erroneous control being effected due to increasing fouling. Since the invention eliminates the necessity for cleaning the scanning systems during operation of the printing machine, the possibility of an erratic or sudden change in the position of the web is also eliminated, with the result that tearing of the web is reliably prevented. Cleaning of the scanning systems can be performed readily during production-related downtimes of the printing machine, without having to change the lateral position of the paper web. Furthermore, changes in the width of the paper web are automatically compensated for.

Other features which are considered as characteristic for the invention are set forth in the appended claims.

Although the invention is illustrated and described herein as embodied in device for controlling the lateral position of a web in a web printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single figure of the drawing which is a schematic and diagrammatic view of a device for controlling the lateral position of a web of imprintable material in a web printing machine.

Referring now to the FIGURE of the drawing, there is shown therein a web 1 of imprintable material controlled in the lateral position or setting thereof by conventional non-illustrated adjusting members. To detect shifting of the position of the web 1, sensing or scanning systems 2 and 3 are provided at respective edges of the web 1 and, for example, by means of photoelectric cells, transmit a control signal respectively separately to a respective bandpass filter 4 and 5. These filters 4 and 5 permit signals representing only long-term changes in position of the web 1 to be passed. Parallel to each bandpass 4, 5, an unfiltered signal line 6, 7, respectively, extends which, exactly like outputs 8 and 9 from each of the respective bandpass filters 4 and 5, is fed to a switch 10. From the switch 10, the signals are conducted through an operational amplifier 11 to the non-illustrated control members at the web 1 so that the required position control is effected in accordance with a nominal value i.e. the required setpoint control is effected.

In the illustrated embodiment of the invention, the switch is set so that the paper web 1 is controlled from the right-hand scanning system 2 (at the top of the FIGURE), for example, because the left-hand web edge at the bottom of the FIGURE is not cleanly cut. The course of the signal in the signal line 6 corresponds somewhat to the plot diagram shown in the FIGURE in alignment with the signal line 6. The amplitude A of the web edge position shift corresponds to the disturbance. The ordinate measures voltage V and the abscissa the time t over which the disturbance occurs. Superimposed upon this disturbed signal course is the course of the signal of the left-hand web edge which is filtered from the scanning system 3 via the bandpass filter 5. A corresponding plot diagram of voltage against time is likewise located in alignment with the output 9. The respective filters 4 and 5 permit long-term changes resulting from fouling of the respective scanning systems 2 and 3 to pass as a signal. These long-term changes are indicated by the angles $\alpha$ in both of the aforementioned plot diagrams. This linear, long-term change in the control signal then takes such effect in the operational amplifier 11 that, according to the plot diagram 12, only the position changes of the web edges are used as voltage changes for control, whereas the long-term changes produced by the fouling of the photoelectric cells are compensated for. A long-term change of the web width would likewise be recognized as a control signal and would lead to an adjustment of the centralized position of the paper web.

When the switch 10 is set in the middle, the signals of both unfiltered signal lines 6 and 7 are used for centralized controlling, so that dust accumulation on or fouling of the photoelectric cells is neutralized or cancelled out and does not lead to faulty control.

I claim:

1. In a web printing machine, a device for controlling with adjusting members and a measuring device the lateral position of a web traveling rectilinearly in a given plane in the web printing machine, the controlling device having respective optical scanning systems for detecting respective opposite edges of the web on both sides thereof and the respective positions of the edges and, upon lateral shifting of the web, activating the adjusting members for correcting the position of the web in accordance with a nominal value, comprising a respective bandpass filter connected to each of the optical scanning systems, and means for detecting a long-term change in the control signal by the bandpass filter of one of the optical scanning systems, the one optical scanning system being in position yet being idle with respect to controlling the lateral position of the web, the other optical scanning system being active with respect to scanning the respective web edge for controlling the lateral position of the web, the detection of the long-term change in the control signal by the bandpass filter of the one optical scanning system being an indication of fouling of the optical scanning systems, whereby compensation for the fouling may be effected.

2. Device according to claim 1 wherein said optical scanning devices include photoelectric cells for scanning both of the web edges.

3. Device according to claim 1 or 2 including switch means for switching over the control of the lateral position of the web from the optical scanning system at the web edge on one side of the web to the web edge at the other side of the web.

* * * * *